US006362736B1

(12) United States Patent
Gehlot

(10) Patent No.: US 6,362,736 B1
(45) Date of Patent: Mar. 26, 2002

(54) METHOD AND APPARATUS FOR AUTOMATIC RECOVERY OF A STOLEN OBJECT

(75) Inventor: Narayan L. Gehlot, Sayreville, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/477,308

(22) Filed: Jan. 4, 2000

(51) Int. Cl.[7] ..... G08B 13/14
(52) U.S. Cl. ..... 340/568.1; 340/539
(58) Field of Search ..... 340/568.1, 539, 340/505, 10.1, 825.49, 508; 379/37, 51; 455/404; 713/200

(56) References Cited

U.S. PATENT DOCUMENTS 5,497,149 A * 3/1996 Fast ..... 340/426 X
5,748,084 A * 5/1998 Isikoff ..... 340/568.1
5,808,564 A * 9/1998 Simms et al. ..... 340/426 X
5,898,391 A * 4/1999 Jefferies et al. ..... 340/426 X
5,945,915 A * 8/1999 Cromer et al. ..... 340/568.1 X
5,963,131 A * 10/1999 D'Angelo et al. ..... 340/568.1
6,014,079 A * 1/2000 Huang ..... 340/568.1 X

OTHER PUBLICATIONS

Heilmann, Kathryn et al., "Intelligent Agents: A Technology And Business Application Analysis", Nov. 1995.

Nwana, Hyacinth S., "Software Agents: An Overview," Knowledge Engineering Review, vol. 11, No. 3 pp 205–244, Oct./Nov. 1996.

* cited by examiner

*Primary Examiner*—Thomas Mullen

(57) ABSTRACT

A system for automatically locating a personal electronic object is described. The system comprises: a communicator; a location sensor; and a security controller. The security controller activates the location sensor to determine a location of the personal electronic object. When security of the system is compromised and access to a computer network or a wireless network is available, the location is transmitted through the communicator.

45 Claims, 4 Drawing Sheets

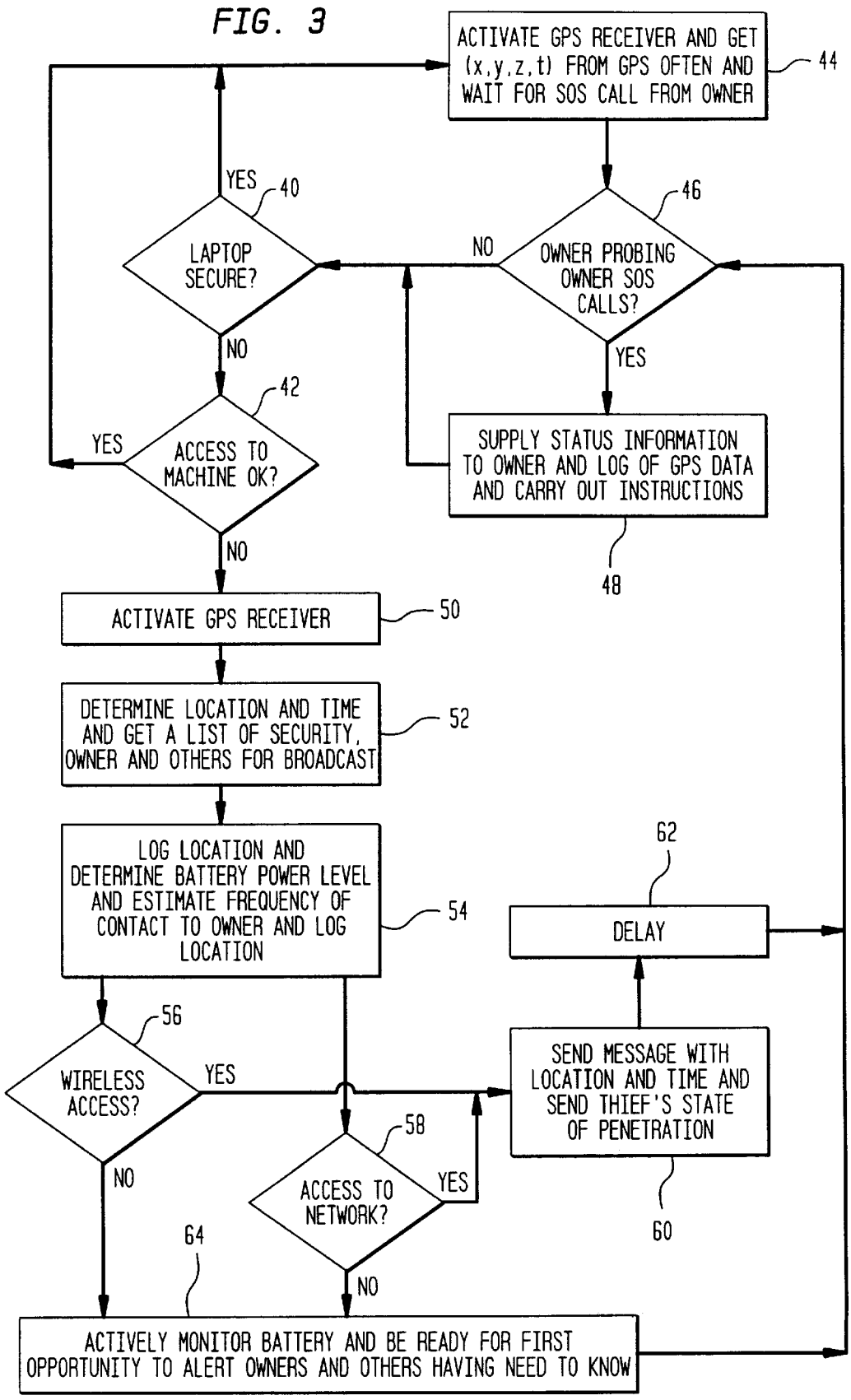
FIG. 3
ACTIVATE GPS RECEIVER AND GET (x,y,z,t) FROM GPS OFTEN AND WAIT FOR SOS CALL FROM OWNER
44
YES
40
LAPTOP SECURE?
NO
46
OWNER PROBING OWNER SOS CALLS?
NO
YES
42
YES
ACCESS TO MACHINE OK?
SUPPLY STATUS INFORMATION TO OWNER AND LOG OF GPS DATA AND CARRY OUT INSTRUCTIONS
48
NO
ACTIVATE GPS RECEIVER
50
DETERMINE LOCATION AND TIME AND GET A LIST OF SECURITY, OWNER AND OTHERS FOR BROADCAST
52
LOG LOCATION AND DETERMINE BATTERY POWER LEVEL AND ESTIMATE FREQUENCY OF CONTACT TO OWNER AND LOG LOCATION
54
62
DELAY
56
WIRELESS ACCESS?
YES
SEND MESSAGE WITH LOCATION AND TIME AND SEND THIEF'S STATE OF PENETRATION
58
NO
ACCESS TO NETWORK?
YES
60
64
NO
ACTIVELY MONITOR BATTERY AND BE READY FOR FIRST OPPORTUNITY TO ALERT OWNERS AND OTHERS HAVING NEED TO KNOW

METHOD AND APPARATUS FOR AUTOMATIC RECOVERY OF A STOLEN OBJECT

FIELD OF THE INVENTION

This invention relates generally to an electronic method and apparatus for locating an object, and more particularly to such methods and apparatus for locating a lost or stolen object.

BACKGROUND OF THE INVENTION

High value personal electronic objects, such as notebook computers, laptop computers, pocket and palm computers are easily misplaced, unintentionally left behind by a user, or stolen. In 1997 alone over one billion dollars worth of laptop computers were stolen in the United States and the rate of theft is rising at 148% a year. Employees conducting business away from home are increasingly becoming victims of economic espionage through loss of proprietary data stored in misappropriated laptops. Even when employees take measures to physically secure their laptop computers, the security measures are being compromised.

Current electronic locating devices require activation by a user and that the user to be able to hear or detect an alert signal generated by the personal electronic object, such as a notebook computer. When the notebook computer is removed from its case or when a security cable is cut, an alarm sounds. With this type of system, there may be a considerable delay from the time when the user misplaces the personal electronic object and when the user realizes that it has been misplaced. By that time, the misplaced personal electronic object may be a considerable distance away from the user. Existing methods of theft prevention require the user to be in the vicinity of the personal electronic object as the existing methods neither notify the user remotely through a telephone call nor provide coordinate information on the location of the object. Also, existing methods of theft prevention do not aid in automatic recovery of stolen personal electronic objects.

Accordingly, there is a need for a personal electronic object locating system, which aids in automatic locating, tracking, securing and recovery of the personal electronic object.

SUMMARY OF THE INVENTION

The present invention is a system for automatically locating a personal electronic object. The system comprises: a communicator, a location sensor; and a security controller. The security controller activates the location sensor to determine a location of the personal electronic object. When security of the system is compromised and access to a computer network or a wireless network is available, or the owner initiates a query, the location is transmitted through the communicator.

A method is also described in accordance with the present invention.

BRIEF DESCRIPTION OF THE DRAWINGS

A more complete understanding of the present invention may be obtained from consideration of the following description in conjunction with the drawings in which:

FIG. 3 is a flow chart of the system; and

DETAILED DESCRIPTION OF VARIOUS ILLUSTRATIVE EMBODIMENTS

Although the present invention is particularly well suited for use with a laptop computer and shall be described with respect to this application, the methods and apparatus disclosed here can be applied to other high-value personal electronic objects including pocket computers, palm computers, and computer systems, as well as other items.

The Global Positioning System (GPS) is a reliable and highly accurate, three-dimensional navigation system. The GPS system consists of a number of satellites that orbit the earth twice a day transmitting precise timing information. A network of ground stations and passive user receivers process information from several of the overhead satellites. Each satellite continuously broadcasts pseudo random codes at L-band frequencies, for example L1 and L2. L1 is modulated with two types of code, the coarse/acquisition code (CA-code) and precision code (P-code). L2 carries an encrypted P-code. The network of ground stations are at precisely known locations.

All GPS satellites contain a cesium clock, which is periodically compared with universal standard time at the ground stations. Corrections are transmitted to the satellites from the ground station. To determine a location (latitude, longitude, altitude, and time) a user requires the simultaneous signal from four or more satellites orbiting the earth. Simultaneous signals from at least three satellites can be used to provide two-dimensional positioning (latitude and longitude). The signals are analyzed and interpreted by the GPS receiver to determine the location. The interval between the transmission and the reception of the satellite signal is used to calculate a receiver's distance from each of the satellites being used. Those distances are used in algorithms to compute a position.

Selective Availability (SA) is a method that reduces the accuracy of the GPS signal for civilian and unauthorized users. SA inserts random errors into the system and reduces the CA-code accuracy. However, this prevents access by peaceful users to high precision navigational data.

While high precision navigational data is necessary for some applications, lower precision data obtained from the coarse/acquisition code is sufficient even without correction for many applications. While the present invention is described utilizing the commercial form of GPS developed by the US, it is equally well suited for use with other systems, such as the Russian GLONASS system.

Figure 1:
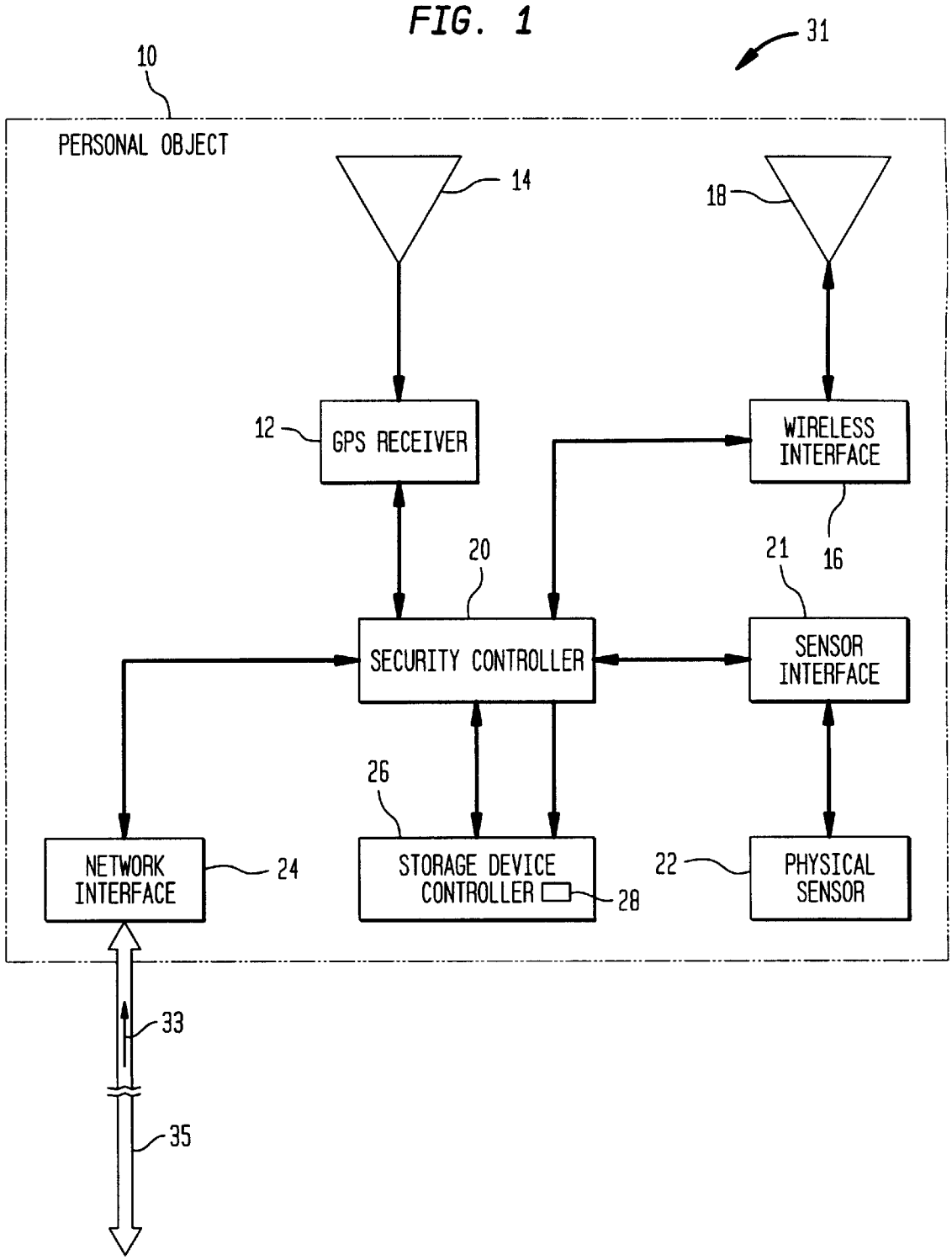
FIG. 1 is high-level block diagram of the system.

Referring to FIG. 1, there is shown a high-level block diagram of a system for automatic recovery of a stolen personal electronic object. A personal electronic object 10 contains a GPS receiver 12, wireless interface 16 (cellular telephone, PCS, mobile telephone, wireless modem, etc.), security controller 20, sensor interface 21, security sensor 22, network interface 24, and storage device 26. The security controller 20 can be integrated into the functionality of an existing onboard microprocessor executing control functions in software or be a dedicated device. A GPS antenna 14 is coupled to the GPS receiver 12. The wireless interface 16 is coupled to a corresponding antenna 18. The GPS receiver 12, the wireless interface 16, and the network interface 24 are coupled to the security controller 20. Sensor interface 21 is coupled to the security controller. The security sensor 22 is coupled to the sensor interface 21 and adapted to sense when the personal electronic object 10 is taken apart or the case opened. The network interface 24 such as a wireless modem, provides access to a communications network capable of sending and receiving e-mail. While the network interface 24 is described as a wireless modem, the network interface 24 can be any of a variety of wired or wireless network interfaces which are suitable for providing access for sending and receiving e-mail. The storage device 26, such as a hard disk drive, solid state memory, etc., is coupled to the security controller 20. The storage device 26 contains an erase device 28 such as a magnetic coil or other suitable bulk erase circuitry.

When activated by the security controller 20, the GPS receiver 12 determines the present location coordinates (x, y, z and t). This is accomplished when the GPS receiver 12 listens, through a GPS antenna 14, to signals from a constellation of satellites that orbit the earth twice a day, transmitting precise timing information. The interval between the transmission and the reception of the satellite signals is used to calculate a receiver's distance from each of the satellites being used. Those distances are used in algorithms to compute an approximate position and time (latitude, longitude, altitude, and time).

After receiving the GPS location coordinates, the data can be stored in order to map the exact location of the moving personal electronic object. The security controller 20, acting through the network interface, can easily forward the specific location data (alternatively, location data can be forwarded by the wireless interface 16). The GPS receiver 12, after providing the current location coordinates is placed in standby or deactivated to conserve battery life. The security controller 20 can reactivate the GPS receiver 12 at periodic intervals to provide a trail of the moving personal electronic object. It may be necessary for the security controller 20 to activate the GPS receiver 12 for an interval to obtain a reasonably stable reading, or determine a moving vector.

The security controller 20 determines the security status of the personal electronic object 10 by monitoring the sensor interface 21 to determine when the security sensor 22 has been activated. When the security status is determined to be compromised, which is described below, the security controller 20 activates the GPS receiver 12. After the location of the personal electronic object 10 is determined, the security controller 20 checks for the accessibility of a computer network through the network interface 24. If the computer network is accessible, the security controller 20 sends a message containing the location information and identification data via that network to a predetermined location. If the computer network is determined to not be accessible, such as by timing out while waiting for a response after a predetermined number of attempts, the security controller determines if a wireless link is accessible through the wireless interface 16. If the wireless link receives a response indicating access is available, the security controller 20 attempts to make a call, and thereby sends a message via a wireless network containing the location and identification data to a predetermined destination.

Figure 2:
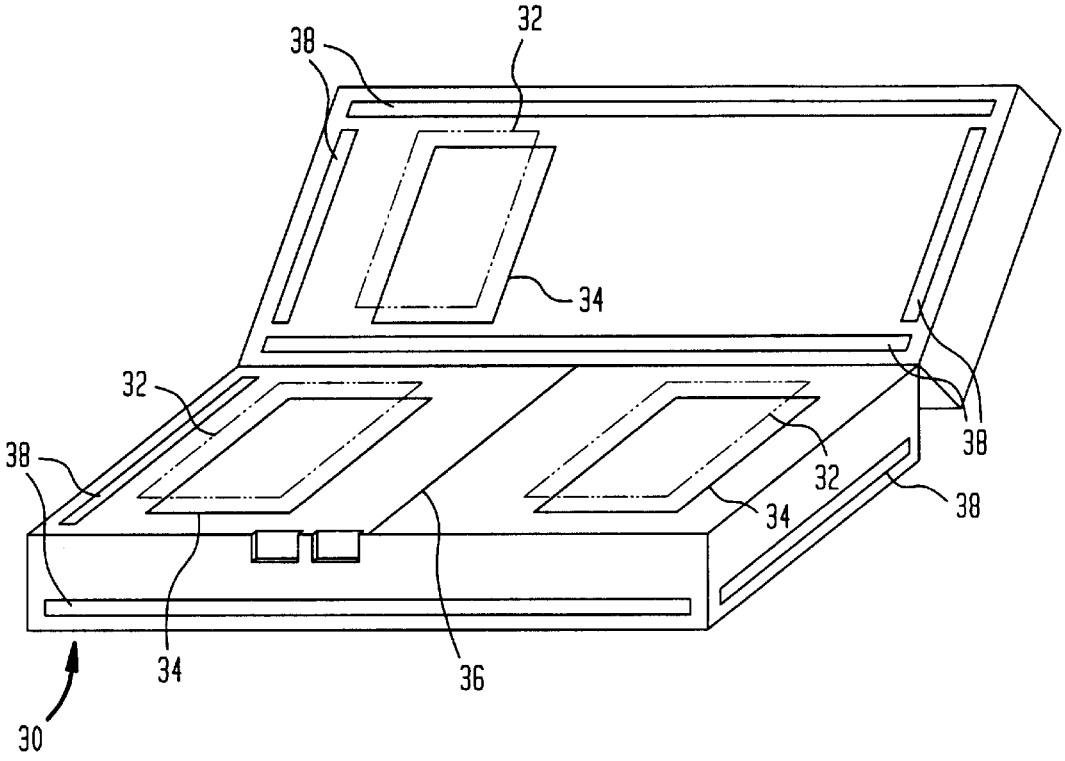
FIG. 2 is a stylized representation of a laptop computer utilizing the system.

Referring to FIG. 2, there is shown a stylized representation of a laptop computer 30 utilizing one embodiment of the system for automatic recovery of a stolen personal electronic object. At least one GPS circuit card 32 and at least one wireless interface circuit card 34 are mounted on the laptop motherboard 36 (or other alternative location) and are connected to at least one antenna 38. It is necessary to take apart the laptop computer 30 to tamper with the GPS circuit card(s) 32 or the wireless interface circuit card(s) 34, which will likely damage the laptop computer 30. In one embodiment, several antennas 38 for the GPS circuit card(s) 32 and the wireless interface circuit card(s) 34 are mounted in different locations within the case of the laptop computer 30. At least one of the GPS circuit cards 32 and at least one of the wireless interface circuit cards 34 are connected at random to at least one antenna 38. As a random GPS circuit card 32, random wireless interface 34 and random antenna 38 are connected upon power up, it is difficult to disable the system. A thief attempting to disable the present invention by removing the antennas 38, GPS circuit cards, or the wireless interface circuit cards 34, would result in considerable damage to the laptop computer 30, thus again minimizing the resale value of the laptop computer 30.

In one embodiment, selection of an antenna can be randomly implemented by using a switch. The switch preferably will have minimum power consumption, high switching speed and offer low switching resistance. A mechanical DIP switch may also be used instead and controlled by relays via laptop serial port. If it is assumed that there are X number of antennas, the computer will choose a random number (or current date ORed with current time and all digits added to form a single digit between 0 and 9) less than X at the first power up. This number can be used to decode the address of the switch or multiplexer connecting a given antenna. If the selected antenna is discovered to be absent (by the lack of any signal presence at the antenna connection), the computer will choose the next random number less than X and cycle through all the antenna connections until a good antenna connection is achieved. The random antenna mode selection is automatically invoked in the absence of a signal or sudden disappearing of the signal.

A wireless interface 16, may be connected through an external bus/ connector or on an internal dedicated bus. The wireless interfaces 16 are all turned on simultaneously at the first power on. Assuming that there are Y number of wireless interfaces 16, then the laptop computer 30 can choose a random number less than Y at the first power up. This number can be used to decode the address of the switch or multiplexer connecting a particular wireless interface. If the selected wireless interface is discovered to be absent (by the lack of any signal acknowledgment at the selected connection) the computer 30 will choose the next random number less than Y and cycle through all the wireless interfaces 16 until wireless access is achieved.

Referring to FIG. 3, there is shown a flow diagram of the functionality of the security system in a personal electronic object, such as a laptop computer. In step 40 security of the laptop is determined. If the laptop is considered secure (as described below), in step 44 the invention optionally activates the GPS receiver and gets and stores x, y, z & t information, thereby providing a trail that can be followed which starts prior to discovery of a theft. Associated with the security determination of step 40 is a check to see if a remote query signal (probing) has been received from step 46.

Referring briefly back to FIG. 1, the remote query signal can be a wireless call 31 to the laptop computer or a network communication such as an e-mail 33, over a communication network 35, directed to the laptop computer. If no remote query signal has been received, then no further action is taken except to periodically check the security of the laptop computer. If a remote query signal (probe) has been received, status information is supplied to the owner with a log of available GPS data in step 48. The security status is determined to be compromised when the security controller 20 determines, by monitoring the sensor interface 21, that the security sensor 22 has been activated. Various means for determining that the security status has been compromised can be used, such as: detection of a predetermined number of unsuccessful log-in attempts; activation of security sensors (pressure, photo, thermal, etc.) inside the laptop housing (as by being touched or disturbed); or failure of a user to identify personal information of the owner, such as date of birth, social security number, wife/mother's maiden name, work phone number, fingerprints, facial features, or eye retinal scans, etc. When the security of the laptop computer is considered compromised, the system for automatic recovery of a misappropriated object is activated automatically.

If the security is compromised, a check is made in step 42 to determine if the access to the machine is valid; if a determination of valid access is made, the method goes to step 44. If the access is determined to not be valid, the GPS receiver is activated in step 50, without alerting the possessor of the laptop computer, and in step 52 the GPS receiver obtains the necessary location information. In step 54 a history/log file is created. Once activated, the GPS receiver can repeatedly calculate its position to establish tracking information for the misappropriated computer. The location information can be translated into a physical location including country, state, city, and street address, thus providing exact location for automatic assistance in theft recovery. The translation from GPS coordinates to a physical location can be accomplished by utilizing a suitable database look-up.

In step 58, the method of the invention makes a determination of whether the laptop computer is connected to a network such as the Internet. For example, the TCP/IP protocol enables pinging, to determine if a remote machine is active and available for Internet access. If a network connection is found, then the security controller 20 of FIG. 1 will automatically send in step 60 through the network interface 24 of FIG. 1 a message, such as to the police, selling agent, owner and/or manufacturer's web site. The message may be an e-mail message utilizing Simple Mail Transfer Protocol (SMTP). The e-mail message would contain a reporting location identifier, such as an e-mail address, device identification information and location tracking information. The system will delay a predetermined time, in step 62, after successful communication before attempting to again communicate updated information.

Alternatively, the message from the security controller/network interface may be a posting to a World Wide Web (WWW) site for automated processing and handling. Utilizing a TCP/IP interface the security controller can transfer to a reporting location, such as an Internet URL, device identification information and location tracking information. The WWW site would utilize an intelligent agent capable of analyzing the information and contacting the appropriate individuals and authorities.

It should be noted that an intelligent agent must have the capability to take actions leading to the completion of a task or objective, such as accessing security databases for validation of credit card information, reading e-mail etc., without trigger or input from an end-user. The details of the programming of the intelligent agent are known to those skilled in the art. The functioning and design of intelligent software agents are described in "Software Agents: An Overview" by Hyacinth S. Nwana, Knowledge Engineering Review, Vol. 11, No. 3 pp 1–40, September 1996 and "Intelligent Agents: A Technology And Business Application Analysis" by Kathryn Heilmann et al., URL: http://www-iiuf.unifr.ch/pai/users/chantem/heilmann, 1998.

If there is no network connection immediately available, then the security controller will periodically check for access and take advantage of the first opportunity of a network connection being found to send the message. If a network connection can not be made, or alternatively as a parallel operation to checking for network access, a check for access through a wireless interface is made in step 56. If wireless access is available, then in step 60 the wireless interface device 16 of FIG. 1 is used to send a message by dialing an appropriate telephone number such as 911. Other destinations for calling may include the police, owner, security administrator, selling agent and/or manufacturer at a predetermined destination. The system will delay a predetermined time, in step 62, after successful communication before attempting to again communicate updated information.

In step 64 the system will actively monitor the laptop battery if access is not available to a network or to a wireless interface. At the first available opportunity, when access is determined to be available to a network or a wireless interface, the system will alert a responsible person or organization as to the security breach.

Alternatively, in step 46, a user who has discovered that his/her laptop is missing or stolen can dial the wireless interface of the computer through an assigned telephone number, login remotely and query the security controller to cause the GPS receiver to remotely determine the location of the laptop computer, and, as well, to determine the status of penetration of the laptop by the unauthorized user/operator without alerting that person. When the laptop computer sends a message or is called by a user, the security controller can transfer location information and device details, such as a serial number, model, purchase and owner information. The telephone dial-in feature can also be used for personal/third party safety/security monitoring of an authorized individual traveling with the laptop computer.

Thus, with a device incorporating the automatic recovery method of the invention, an unauthorized acquirer must destroy or dispose of the personal electronic object to avoid being tracked and caught. The present invention permits tracking where GPS signals can be received. Once misappropriated, the personal electronic object will notify one or more known sources with its whereabouts.

Thus, the invention provides, real-time, anywhere, continuous theft deterrent and an automatic recovery system. The invention permits the automatic recovery of stolen laptop computers or other high value personal electronic objects while providing the exact path of travel from the place of theft to its final or current location, thus greatly assisting law enforcement. Thieves would stop stealing objects equipped with the present invention or risk being caught.

Figure 4:
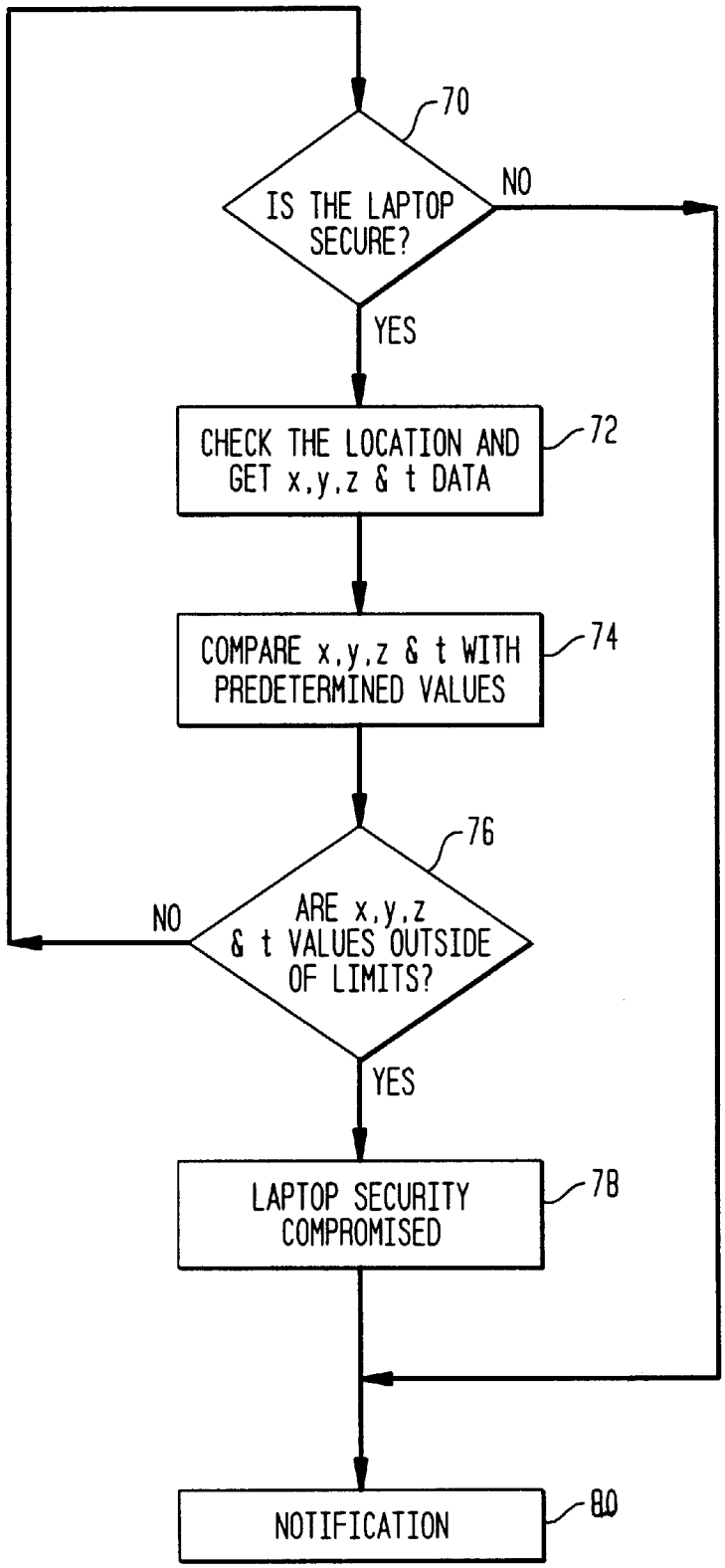
FIG. 4 is a flow chart of a location/boundary security limit feature.

An alternate embodiment of the security-breach detection methodology of the invention is shown in the flowchart of FIG.4. The methodology of this embodiment begins, at step 70, with an assessment of the security of the laptop computer. Absent an a priori determination of a security breach from an alternative security check, the system considers the unit secure and proceeds to a periodic check of the unit location, in step 72, using the GPS functionality previously described. A location so determined is then compared, in step 74, with a predefined travel limit (security boundary) for the unit. A decision step 76 is then applied based on that comparison. If the location data show the unit to be operating within the security boundary, indicative of the absence of a security breach, the process returns to step 70 for another iteration. However, in the case where the location data show the unit to be operating outside the security boundary, the security of the unit will be considered to have been compromised, in step 78, and the process moves to notification step 80. Similarly, a determination of a security breach from an alternate security check in step 70 would proceed directly to notification step 80. As will be appreciated, that notification step can be carried out by any of the heretofore described notification processes of the invention.

As will be appreciated by those skilled in the art, the security boundary for this embodiment is limited only by the accuracy of the GPS receiver. For example, the security boundary may be a particular office, building or group of buildings. The security boundary may also be keyed to a date/time parameter, dynamically expanding and contracting to coincide with expected movements of the authorized user.

The present invention is particularly well suited for high value personal electronic objects, such as laptop computers, which may already be configured with the necessary hardware, a GPS receiver and a wireless interface, or at least can be readily so configured. In this embodiment a security controller is coupled to the GPS receiver, wireless interface, and suitable security sensors, utilizing the processing and storage capability of the computer. While the present invention can be an add-on device for existing equipment, ideally it would be built into a motherboard of a laptop computer or similar device.

Numerous modifications and alternative embodiments of the invention will be apparent to those skilled in the art in view of the foregoing description. The security controller can be integrated into the functionality of an existing portable computer, as part of the CPU, or can be a dedicated device. When the security controller is integrated into a CPU, detecting and disabling the device will be very difficult. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed:

1. A device for automatically locating a personal electronic object comprising:

at least two wireless communicators;

at least two location sensors; and a security controller;

wherein said security controller, in response to a stimulus, determines a location of the personal electronic object with at least one of said at least two location sensors and transmits said location through at least one of said at least two wireless communicators.

2. The device as recited in claim 1 wherein at least one of said at least two wireless communicators is a network interface.

3. The device as recited in claim 1 wherein at least one of said at least two location sensors is a global positioning system.

4. The device as recited in claim 1 further comprising a storage device for recording a sequence of location data for the personal electronic object, wherein movement of the object may be tracked.

5. The device as recited in claim 4 wherein said security controller transmits said sequence of location data for the personal electronic object through at least one of said at least two wireless communicators.

6. The device as recited in claim 4 wherein said storage device includes an erase device, the security controller operable to cause the erase device to erase data on the storage device.

7. The device as recited in claim 6 wherein the security controller causes the erase device to erase data in response to a signal from a remote location.

8. The device as recited in claim 1 wherein said stimulus is a remote trigger.

9. The device as recited in claim 1 wherein said stimulus is responsive to a physical tamper sensor.

10. The device as recited in claim 1 wherein said stimulus is responsive to an improper response by a user.

11. The device as recited in claim 1 wherein at least one of said at least two location sensors is selected at random.

12. The device as recited in claim 1 wherein at least one of said at least two wireless communicators is selected at random.

13. A method for automatically locating a personal electronic object comprising the steps of:

providing the personal electronic object with at least two location sensors and at least two wireless communicators;

detecting a security stimulus;

determining a location of the personal electronic object with at least one of said at least two location sensors; and communicating said location of the personal electronic object with at least one of said at least two wireless communicators.

14. The method as recited in claim 13 wherein at least one of said at least two wireless communicators is a network interface.

15. The method as recited in claim 13 wherein the step of determining a location utilizes a global positioning system.

16. The method as recited in claim 13 further comprising the step of storing a series of locations of the personal electronic object wherein movement of the personal electronic object is tracked.

17. The method as recited in claim 16 wherein the step of communicating includes transmitting said series of locations of the personal electronic object.

18. The method as recited in claim 13 wherein said security stimulus is derived from a remote trigger.

19. The method as recited in claim 13 wherein said security stimulus is derived from a physical tamper sensor.

20. The method as recited in claim 13 wherein said security stimulus is derived from an improper response by a user.

21. The method as recited in claim 13 further comprising the step of randomly selecting a location sensor to determine said location.

22. The method as recited in claim 13 further comprising the step of randomly selecting a communicator before communicating.

23. The method as recited in claim 13 further comprising the step of randomly selecting an antenna before communicating.

24. A system for automatically locating a personal electronic object, said object having at least two global positioning system receivers and at least two wireless communication interfaces, the system comprising:

a stimulus sensor; and a security controller;

wherein said security controller, in response to a signal from said stimulus sensor, utilizes at least one of said global positioning system receivers to determine a location of the personal electronic object and manages transmission of the location through at least one of said at least two wireless communication interfaces.

25. The system as recited in claim 24 further comprising a storage device for recording a series of locations of the personal electronic object wherein movement of the personal electronic object may be tracked.

26. The system as recited in claim 25 wherein said security controller transmits said series of locations of the personal electronic object through at least one of said at least two wireless communication interfaces.

27. The device as recited in claim 25 wherein said storage device includes an erase device, the security controller operable to cause the erase device to erase data on the storage device.

28. The device as recited in claim 27 wherein the security controller causes the erase device to erase data in response to a signal from a remote location.

29. The system as recited in claim 24 wherein said stimulus sensor detects a remote trigger.

30. The system as recited in claim 24 wherein said stimulus sensor detects physical tampering with the personal electronic object.

31. The system as recited in claim 24 wherein said stimulus sensor detects an improper response by a user.

32. A device for automatically locating a personal electronic object comprising:

at least two wireless interfaces;

at least two location sensors; and a security controller;

wherein said security controller compares a location of the personal electronic object determined with at least one of said at least two location sensors to determine if said location is within a predefined boundary, when said location is not within said predefined boundary then said security controller transmits said location through at least one of said at least two wireless interfaces.

33. The device as recited in claim 32 wherein at least one of said at least two wireless interfaces is a network interface.

34. The device as recited in claim 32 wherein at least one of said at least two wireless interfaces is a telecommunication device.

35. The device as recited in claim 32 wherein at least one of said at least two location sensors is a global positioning system.

36. The device as recited in claim 32 further comprising a storage device for recording a series of locations of the personal electronic object wherein movement of the personal electronic object is tracked.

37. A method for automatically locating a personal electronic object comprising the steps of:

providing the personal electronic object with at least two location sensors and at least two wireless communicators;

determining a location of the personal electronic object with at least one of said at least two location sensors;

comparing said location to determine if said location is within a predefined boundary; and communicating said location of the personal electronic object with at least one of said at least two wireless communicators if said location is outside of said predefined boundary.

38. The method as recited in claim 37 wherein at least one of said at least two wireless communicators is a network interface.

39. The method as recited in claim 37 wherein the step of determining a location utilizes a global positioning system.

40. A system for automatically locating a personal electronic object, said object having at least two global positioning system receivers and at least two wireless communication interfaces, the system comprising:

a stimulus sensor; and a security controller;

wherein said security controller utilizes at least one of said at least two global positioning system receivers to determine a location of the personal electronic object, said location when outside a predefined boundary is transmitted through at least one of the at least two wireless communication interfaces.

41. A device for automatically locating a personal electronic object comprising:

at least one communicator;

at least one location sensor; and a security controller;

wherein said security controller, in response to a stimulus, determines a location of the personal electronic object with one of said at least one location sensor and transmits said location through one of said at least one communicator; wherein one of said at least one location sensor is selected at random.

42. A device for automatically locating a personal electronic object comprising:

at least one communicator;

at least one location sensor; and a security controller;

wherein said security controller, in response to a stimulus, determines a location of the personal electronic object with one of said at least one location sensor and transmits said location through one of said at least one communicator; wherein one of said at least one communicator is selected at random.

43. A method for automatically locating a personal electronic object comprising the steps of:

detecting a security stimulus;

randomly selecting a location sensor to determine a location of the personal electronic object;

determining said location of the personal electronic object; and communicating said location of the personal electronic object;

wherein said communicating step transmits said location of the personal electronic object through at least one of at least two wireless interfaces.

44. A method for automatically locating a personal electronic object comprising the steps of:

detecting a security stimulus;

determining a location of the personal electronic object;

randomly selecting a communicator; and communicating said location of the personal electronic object.

45. A method for automatically locating a personal electronic object comprising the steps of:

detecting a security stimulus;

determining a location of the personal electronic object;

randomly selecting a location sensor to determine said location; and communicating said location of the personal electronic object.

* * * * *